US008936408B2

(12) United States Patent
Fukumoto et al.

(10) Patent No.: US 8,936,408 B2
(45) Date of Patent: Jan. 20, 2015

(54) LIQUID MATERIAL FEEDING CONTAINER

(75) Inventors: Takeo Fukumoto, Fujioka (JP); Satoru Sumiyoshi, Fujioka (JP); Mitsuru Endou, Fujioka (JP)

(73) Assignee: Mitsubishi Pencil Company, Limited, Shinagawa-Ku, Tokyo (JP)

( * ) Notice: Subject to any disclaimer, the term of this patent is extended or adjusted under 35 U.S.C. 154(b) by 732 days.

(21) Appl. No.: 13/202,359

(22) PCT Filed: Mar. 3, 2010

(86) PCT No.: PCT/JP2010/053445

§ 371 (c)(1),
(2), (4) Date: Aug. 19, 2011

(87) PCT Pub. No.: WO2010/101185

PCT Pub. Date: Sep. 10, 2010

(65) Prior Publication Data

US 2012/0039661 A1 Feb. 16, 2012

(30) Foreign Application Priority Data

Mar. 3, 2009 (JP) ..... 2009-048801
Mar. 2, 2010 (JP) ..... 2010-045475

(51) Int. Cl.
*B43K 5/06* (2006.01)
*A45D 40/20* (2006.01)
*A45D 34/04* (2006.01)

(52) U.S. Cl.
CPC ..... *A45D 40/205* (2013.01); *A45D 34/04* (2013.01); *A45D 40/20* (2013.01); *A45D 34/042* (2013.01); *A45D 2200/055* (2013.01)
USPC ..... 401/174; 401/172

(58) Field of Classification Search
CPC ..... A45D 40/04; B65D 83/0005; B65D 83/0011; B65D 83/0027; B65D 83/0033; B65D 87/0072
USPC ..... 401/171, 172, 173, 174, 68, 75
See application file for complete search history.

(56) References Cited

U.S. PATENT DOCUMENTS 5,573,341 A * 11/1996 Iaia ..... 401/172
5,803,640 A 9/1998 Nakajima et al.

(Continued)

FOREIGN PATENT DOCUMENTS

EP 2 123 188 A1 11/2009
JP 61-173997 A 8/1986

(Continued)

OTHER PUBLICATIONS

Notification of Transmittal of Translation of the International Preliminary Report on Patentability Chapter I or Chapter II (Form PCT/IB/338 and PCT/IB/373) and the Written Opinion of the International Searching Authority (Form PCT/ISA/237) dated Sep. 22, 2011, issued in the International Application No. PCT/JP2010/053445.

(Continued)

*Primary Examiner* — David Walczak
(74) *Attorney, Agent, or Firm* — Buchanan, Ingersoll & Rooney PC

(57) ABSTRACT

In the liquid material feeding container, a piston is formed with a seal portion at a front portion thereof, being sliding in contact with an inner wall of a housing portion of a barrel body, and a cylindrical portion having projections in an outer periphery of a rear end portion and a female thread portion in an inner periphery thereof, and in an outer peripheral surface of the front portion extending frontward from the above-described operating portion of the above-described rotating element, a male thread portion is formed, and in the above-described barrel body, a space of the housing portion is formed in a frontward portion and a groove portion with which the projection is engaged is formed in a backward portion along an axial direction.

8 Claims, 5 Drawing Sheets

(56) References Cited

U.S. PATENT DOCUMENTS

| | | | | |
|---|---|---|---|---|
| 6,474,891 | B1 * | 11/2002 | Liu | 401/174 |
| 2009/0283033 | A1 | 11/2009 | Akaishi et al. | |
| 2010/0104345 | A1 | 4/2010 | Nasu et al. | |

FOREIGN PATENT DOCUMENTS

| | | | |
|---|---|---|---|
| JP | 1-115415 | U | 8/1989 |
| JP | 7-265123 | A | 10/1995 |
| JP | 9-322819 | A | 12/1997 |
| JP | 3542164 | B2 | 7/2004 |
| JP | 2007-130157 | A | 5/2007 |

OTHER PUBLICATIONS

Partial English Translation of Japanese Laid-Open Application No. H01-115415U.

International Search Report (PCT/ISA/210) issued on Jun. 15, 2010, by Japanese Patent Office as the International Searching Authority for International Application No. PCT/JP2010/053445.

Extended Search Report issued on Sep. 4, 2014, by the European Patent Office in corresponding European Patent Application No. 10748779.5-1653 (3 pages).

* cited by examiner 18
18a
18b
36
38
52

LIQUID MATERIAL FEEDING CONTAINER

TECHNICAL FIELD

The present invention relates to a liquid material feeding container which houses liquid materials such as liquid or fluid cosmetics or medicines in a housing portion of a barrel body and supplies the housed liquid materials to an application portion by a feeding operation to rotate a rear end.

BACKGROUND ART

In a conventional and general liquid material feeding container which rotates, as shown in examples of Japanese Patent Application Laid-open Hei 9 No. 322819 (Patent Literature 1) and the like, a feeding mechanism portion is comprised of six parts of a barrel body, a piston, a thread rod, a thread socket, a feed element and a crown and is configured to be able to feed an appropriate amount of liquid materials to an applying element by a feeding operation of the feed element (a rotating operation of the feed element through the crown with respect to the thread socket).

However, in the liquid material feeding container of the above-described type, cost-cutting by further reducing the number of parts and cost-cutting by improving assembly performance are required today.

While cost-cutting is required, a required quality level is high, including quantitative ejection and an enclosed state of content, and it is difficult for the conventional liquid material feeding container to reduce the number of parts while maintaining current performance.

For example, in an applicator described in Japanese Patent Application Laid-open Sho 61 No. 173997 (Patent Literature 2), a push rod (arranged to be prevented from rotating by a barrel cylinder and to slide freely) provided with a piston at a tip end thereof is mated with a rotating element and the rotating element is rotated with respect to the barrel cylinder, so that the piston is advanced and liquid in a liquid reservoir is fed to an applying element. Though a container with the number of parts reduced in this manner is devised, there is a room for improvement of click feeling at the time of a rotating operation, assembly performance and the like.

RELATED ART LITERATURES

Patent Literatures

Patent Literature 1: Japanese Patent Application Laid-open Hei 9 No. 322819

Patent Literature 2: Japanese Patent Application Laid-open Sho 61 No. 173997

SUMMARY OF THE INVENTION

Problem to be Solved by the Invention

As described above, a rotational feeding container becomes expensive because the number of parts is large by any means in order to maintain quality such as quantitative ejection performance, operation feeling at the time of a rotating operation, sealing performance of content and the like and because of complexity of assembly performance due to the increased number of parts.

A problem of the present invention is to provide a liquid material feeding container in which the number of parts is reduced while maintaining quality required for a rotational feeding container and assembly with a simple method is allowed so that the cost is reduced without changing impression of use compared to current products.

Means to Solve the Problem

The present invention provides a liquid material feeding container which houses liquid content in a housing portion provided in a barrel body, and causes an operating portion of a rotating element exposed from a rear end portion of the barrel body to relatively rotate with the barrel body so as to advance a piston in the housing portion and feed the content to the frontward of the barrel body, in which the piston has a seal portion which slides in contact with an inner wall of the housing portion of the barrel body in a front portion thereof and is formed with a cylindrical portion having a projection in an outer periphery of a rear portion and a female thread portion in an inner periphery thereof, a male thread portion which is mated with the female thread portion of the cylindrical portion is formed in an outer peripheral surface of a front portion extending frontward from the operating portion of the rotating element, and the barrel body has a space of the housing portion formed at a frontward portion and has a groove portion with which the projection in the outer periphery of the cylindrical portion is engaged formed at a backward portion along an axial direction.

In the present invention, it is preferable that a projection portion which is elastically urged outward in a radial direction is formed in the rotating element, a plurality of projecting-recessing portions are formed in an inner peripheral portion of the barrel body, and in a state where the male thread portion of the rotating element is mated with the female thread in the cylindrical portion of the piston, the projection portion is engaged with the projecting-recessing portions, and when the rotating element is caused to relatively rotate with the barrel body, the projection portion is engaged and disengaged with and from the projecting-recessing portions.

Further, in the present invention, it is preferable that fitting portions which regulate relative movement in mutual axial directions and enables relative rotation in rotational directions for the rotating element and the barrel body are formed respectively at places opposing to each other in the outer peripheral surface of the front portion of the rotating element and the inner peripheral surface of the barrel body.

Further, in the present invention, it is preferable that a rear-open slit is formed along an axial direction in the cylindrical portion of the piston, and when the male thread portion of the rotating element is linked with the cylindrical portion, it is able to be mounted so that the cylindrical portion opens from the slit by elastic deformation without mating the male thread portion to the female thread portion.

Further, in the present invention, it is preferable that the rotating element is formed into a hollow cylindrical shape over a front portion from the operating portion, and the projection portion is formed into a cantilevered shape in a wall portion of the rotating element in a hollow cylindrical shape and is formed to be thin near a rocking fulcrum at the time of elastic deformation and to have an outer surface of the rocking arm portion formed to be thick being projected outward from the wall portion of the rotating element.

Effect of the Invention

According to a liquid material feeding container of the present invention, with a piston which slides in contact with an inner wall of a housing portion of a barrel body, a cylindrical portion having a projection in an outer periphery of a rear portion and a female thread portion in an inner periphery thereof is formed integrally, a male thread portion which is mated with the female thread portion of the cylindrical portion is formed in an outer peripheral surface of a front portion extending frontward from the operating portion of the rotating element, and the barrel body has a space of the housing portion formed at a frontward portion and has a groove portion with which the projection in the outer periphery of the cylindrical shape is engaged formed at a backward portion along an axial direction.

Accordingly, in the liquid material feeding container of the present invention, by relatively rotating the operating portion of the rotating element with the barrel body, the male thread portion in the outer peripheral surface of the front portion of the rotating element screw-feeds the female thread portion in the inner periphery of the cylindrical portion of the piston to advance the piston in the housing portion, thus making it possible to feed the content to the frontward of the barrel body. Therefore, it is possible to configure the liquid material feeding container with a configuration having less parts of the barrel cylinder integral with the housing portion, the piston integral with the cylindrical portion in which the female thread is formed and the rotating element in which the front portion in which the male thread is formed is integral with the operating portion, and the cylindrical portion is housed in the barrel body and the male thread in the front portion of the rotating element is mated with the female thread in the cylindrical portion to carry out a feeding operation, thus making it possible to hold mating reliably with the barrel body as a strength part. Therefore, it is possible to provide the liquid material feeding container in which the number of parts is reduced while maintaining quality required for the rotational feeding container and assembly with a simple method is allowed so that the cost is reduced without changing impression of use compared to current products.

Note that, in the present invention, it is possible to configure such that a projection portion which is elastically urged outward in a radial direction is formed in the rotating element, a plurality of projecting-recessing portions are formed in an inner peripheral portion of the barrel body, and in a state where the male thread portion of the rotating element is mated with the female thread in the cylindrical portion of the piston, the projection portion is engaged with the projecting-recessing portions, and when the rotating element is caused to relatively rotate with the barrel body, the projection portion is engaged and disengaged with and from the projecting-recessing portions. With this configuration, in a state where the projection portion is engaged with the projecting-recessing portions, the projection portion is engaged and disengaged with and from the projecting-recessing portions when the rotating element is caused to relatively rotate with the barrel body, so that it is possible to rotate the rotating element with click feeling at the time of an operation, and a feed amount of liquid materials is easily grasped and to position and fix in a rotational direction of the rotating element easily, thus the liquid materials are not fed unexpectedly.

Further, in the present invention, fitting portions which regulate relative movement in mutual axial directions and enables relative rotation in rotational directions for the rotating element and the barrel body are able to be formed respectively at places opposing to each other in the outer peripheral surface of the front portion of the rotating element and the inner peripheral surface of the barrel body. With this configuration, it is possible to prevent the rotating element from being fallen from the barrel body reliably.

Further, in the present invention, a rear-open slit is formed along an axial direction in the cylindrical portion of the piston, and when the male thread portion of the rotating element is linked with the cylindrical portion, it is able to be mounted so that the cylindrical portion opens from the slit by elastic deformation without mating the male thread portion to the female thread portion. With this configuration, when the rotating element is linked with the cylindrical portion of the piston, by thrusting the rotating element into the cylindrical portion without rotating the rotating element, it is possible to fit the male thread portion into the female thread portion and linking is enabled only by the thrusting operation without requiring the rotating operation, so that it becomes possible to carry out a linking step very easily and correctly.

Further, in the present invention, it is possible that the rotating element is formed into a hollow cylindrical shape over a front portion from the operating portion, and the projection portion is formed into a cantilevered shape in a wall portion of the rotating element in a hollow cylindrical shape and is formed to be thin near a rocking fulcrum at the time of elastic deformation and to have an outer surface of the rocking arm portion formed to be thick being projected outward from the wall portion of the rotating element. With this configuration, the projection portion is formed to be thin near the rocking fulcrum at the time of elastic deformation, and has the outer surface of the rocking arm portion to be thick being projected outward from the wall portion of the rotating element, so that when the rotating element is caused to rotate inversely, force to be pressed back when the projection portion is engaged with the projecting-recessing portion is caused, but the outer peripheral surface of the rocking arm portion abuts against the inner peripheral surface of the projecting-recessing portion to support the force to be pressed back, thus making it possible to exert excellent effects such as preventing deformation of the rocking arm portion so as to be able to prevent inverse rotation reliably.

MODES FOR CARRYING OUT THE INVENTION

Figure 1:
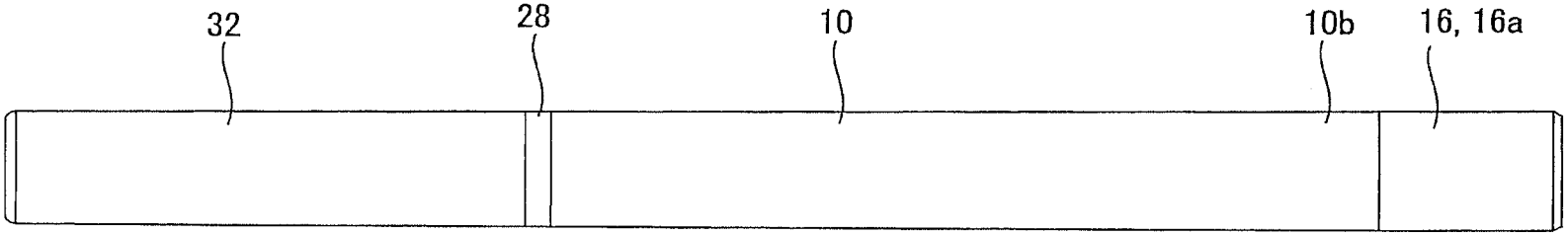
FIGS. 1(*a*) and (*b*) are an entire external view and an entire longitudinal cross sectional view of a liquid feeding container according to an embodiment of the present invention.
Figure 1:
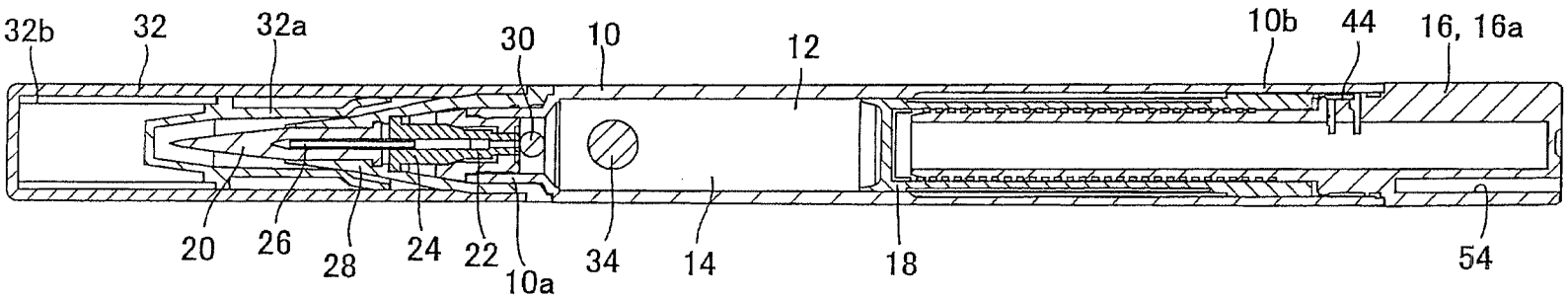

Description will hereinafter be given to embodiments of the present invention with reference to drawings.

FIG. 1 to FIG. 5 are explanatory views of a liquid material feeding container according to an embodiment of the present invention, and in these figures, parts allotted with the same reference numerals represent the same components.

Figure 2:
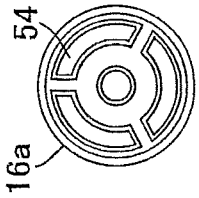
FIGS. 2(*a*), (*b*) and (*c*) are an external view, a longitudinal cross sectional view and a rear view for explaining a state where a piston and a rotating element are linked with a barrel body of the liquid feeding container of FIG. 1.
Figure 2:
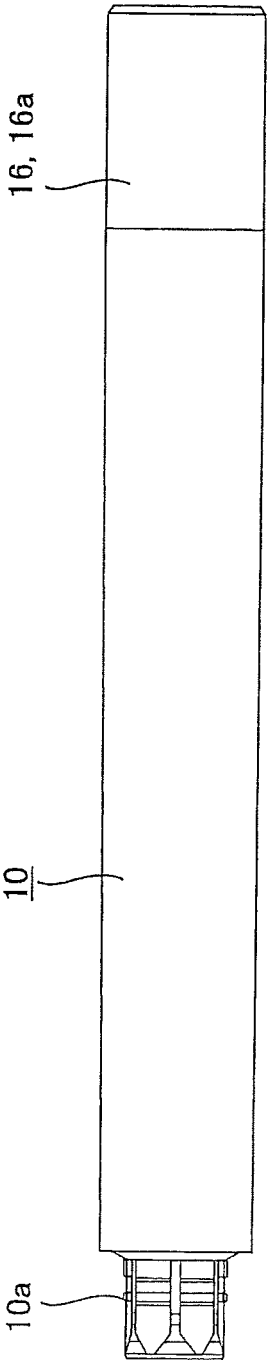
Figure 2:
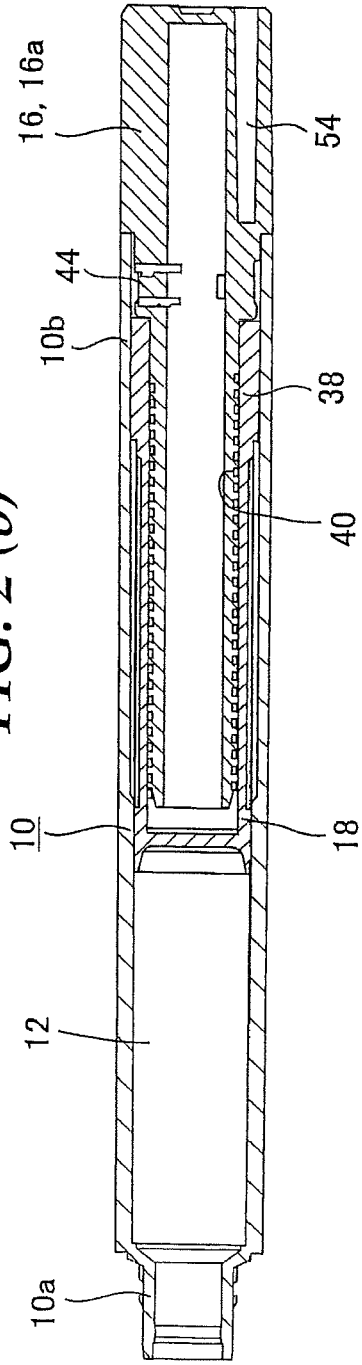

As shown in FIG. 1 and FIG. 2, a liquid feeding container of the embodiment is a liquid material feeding container which houses liquid content 14 in a housing portion 12 provided in a barrel body 10, causes an operating portion 16*a* of a rotating element 16 exposed from a rear end portion 10*b* of the barrel body 10 to relatively rotate with the barrel body 10 so as to advance a piston 18 in the housing portion 12 and feed the content 14 to the frontward of the barrel body 10, and is configured by three parts of the barrel body 10, the rotating element 16 and the piston 18. In the liquid material feeding container according to the embodiment, as shown in FIG. 1, an applicator in which an applying element 20 is provided in a frontward portion of the liquid material feeding container is configured.

In the above-described applicator, as shown in FIG. 1, a seal ball socket 22, a pipe joint 24, a pipe 26, a front barrel 28 and an applying element 20 are attached to a tip end portion 10*a* of the barrel body 10, and the content 14 fed from the housing portion 12 is configured to be ejected to a tip end of the applying element 20 thorough the pipe 26.

The tip end portion 10*a* of the barrel body 10 has a diameter which becomes smaller stepwise with respect to a center portion, and the cylindrical seal ball socket 22 is fitted into the inside of the tip end portion 10*a*. A seal ball 30 is fitted into a rear portion of the seal ball socket 22 and the pipe joint 24 is mounted to a front portion thereof. The pipe 26 is mounted to the frontward of the pipe joint 24, and this pipe 26 is inserted into the applying element 20 made of brush from a rear portion thereof. A hollow communication channel between the pipe joint 24 and the pipe 26 is connected to the applying element 20, and in a state where the seal ball 30 is fitted into the seal ball socket 22, the connection of the above-described hollow communication channel to the housing portion 12 is closed by the seal ball 30. The seal ball socket 22 is provided with a holding configuration of the seal ball 30 which is not illustrated, and the holding configuration is released at the beginning of use, so that the seal ball 30 is fallen into the housing portion 12 and the liquid content 14 is supplied to the applying element 20 through the pipe joint 24 and the pipe 26.

The front barrel 28 encompasses the pipe 26, the pipe joint 24 and the seal ball socket 22 from a rear portion of the above-described applying element 20, and the front barrel 28 whose diameter becomes narrower to be tapered toward a tip end is fitted on the tip end portion 10*a* of the above-described barrel body 10. An inner peripheral surface of the front barrel 28 and an outer peripheral surface of the tip end portion 10*a* of the barrel body 10 are fitted closely to form an anti-fall portion (see FIG. 1 and FIG. 2).

In addition, after use of the applicator, it is formed such that a cap 32 provided with an inner cap 32*a* and an inner cap spring 32*b* is able to be mounted. When the cap 32 is used, the cap 32 is mounted covering the front barrel 28, and with urging force of the inner cap spring 32*b*, the inner cap 32*a* encompasses the front barrel 28 and the applying element 20 and holds hermetic performance of the applying element 20 to prevent drying.

Further, when the applicator is not used, the seal ball 30 is fitted into the seal ball socket 22, and the seal ball 30 is fallen into the housing portion 12 at the beginning of use to bring a flowing state between the housing portion 12 and the pipe 26, and an agitation ball 34 is arranged in the housing portion 12, and by shaking the liquid material feeding container up and down, agitation of the content 14 is carried out.

Figure 4:
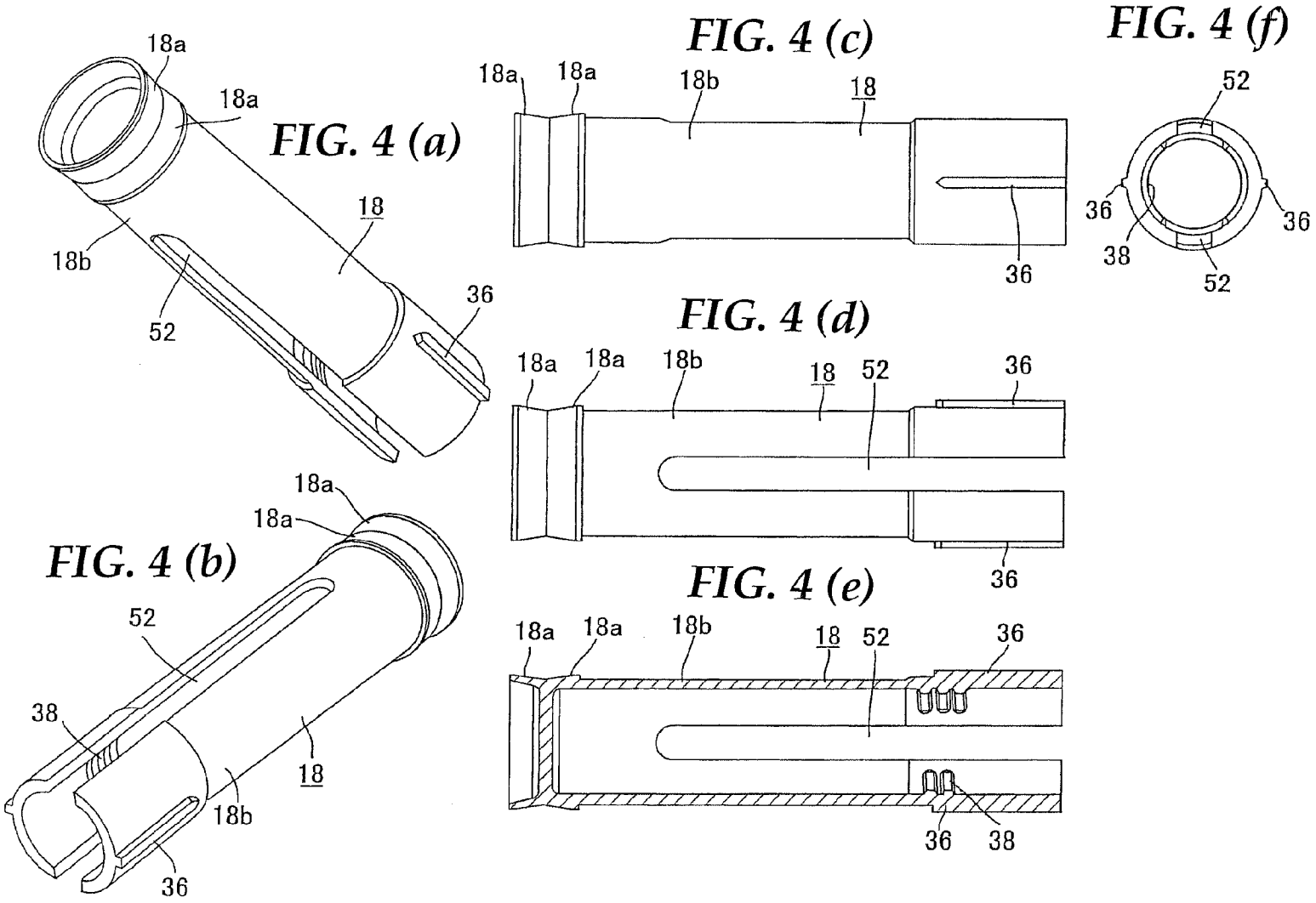
FIG. 4 is view for illustrating the piston of the liquid feeding container of FIG. 1, in which (*a*) is a front-side-hand perspective view, (*b*) is a rear-side-hand perspective view, (*c*) is an external view, (*d*) is an external view seen from the side of a slit, (*e*) is a longitudinal cross sectional view and (*f*) is an axial directional view from the rear side.

Here, as shown in FIG. 4, in the above-described piston 18, two seal portions 18*a* formed along a peripheral direction slide in contact with an inner wall of the housing portion 12 of the barrel body 10 at an outer periphery of a front portion thereof as well as a cylindrical portion 18*b* having a pair of projections 36 comprised of a rib-shaped projection projected outward in a radial direction at an outer periphery of a rear end portion and a female thread portion 38 at an inner periphery thereof is formed. A rear portion of the cylindrical portion 18*b* of the above-described piston 18 is formed to have an outer diameter larger than that of a center portion and slightly smaller than an outer diameter of the above-described seal portion 18*a*, and the projection 36 is formed in an outer peripheral surface extending to a rear end of the rear portion. The projection height of the projection 36 is formed to be higher than the outer diameter of the seal portion 18*a*. In addition, the rear portion of the cylindrical portion 18*b* is formed long, and because the projection 36 also has some height, workability in assembling is able to be improved. Moreover, the formation place of the female thread portion 38 is at an inner periphery of a part close to a place of the rear portion becoming a large diameter stepwise.

In an outer peripheral surface of a front portion extending frontward from the above-described operating portion 16*a* of the above-described rotating element 16, a male thread portion 40 which is mated with the female thread portion 38 of the above-described cylindrical portion 18*b* is formed.

In the above-described barrel body 10, a space of the housing portion 12 is formed in a frontward portion, and a groove portion 42 with which the projection 36 in the outer periphery of the above-described cylindrical portion 18*b* is engaged is formed in a backward portion along an axial direction.

Figure 3:
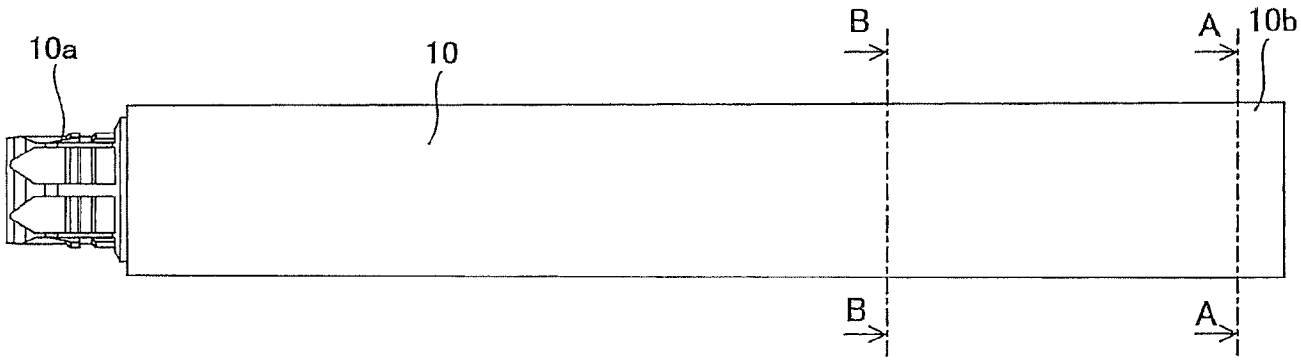
FIG. 3 is view for illustrating the barrel body of the liquid feeding container of FIG. 1, in which (*a*) is a cross sectional view taken along the line A-A in (*c*), (*b*) is a cross sectional view taken along the line B-B in (*c*), (*c*) is an external side view and (*d*) is a longitudinal cross sectional view.
Figure 3:
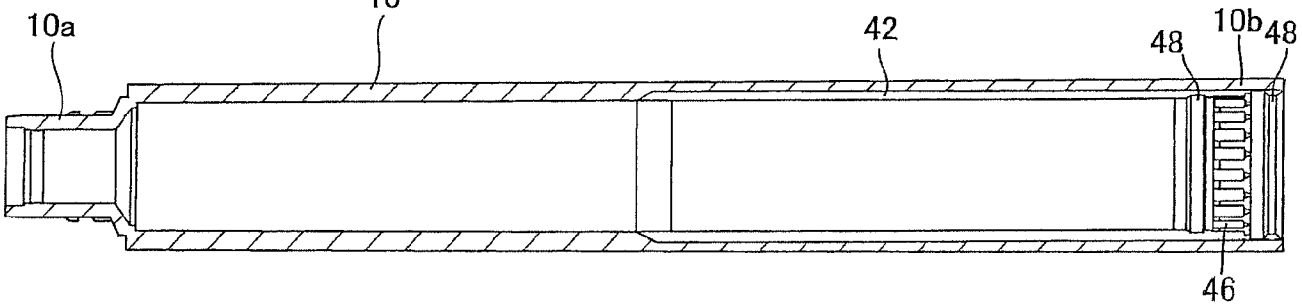
Figure 3:
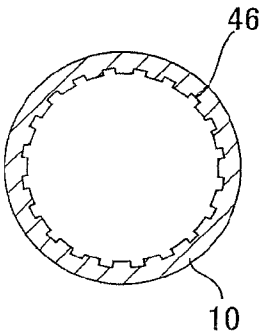
Figure 3:
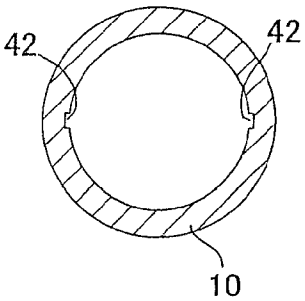

A projection portion 44 which is elastically urged outward in a radial direction is formed in the rotating element 16, and a plurality of rectangle recessing shapes and projecting shapes are formed alternately as a projecting-recessing portion 46 in an inner peripheral portion of the rear end portion 10*b* of the barrel body 10 (see FIGS. 3(*a*) and 3(*d*)). In a state where the male thread portion 40 of the above-described rotating element 16 is mated with the female thread in the cylindrical portion 18*b* of the piston 18, the above-described projection portion 44 is engaged with the above-described projecting-recessing portion 46, and when the rotating element 16 is caused to relatively rotate with the barrel body 10, the above-described projection portion 44 is engaged and disengaged with and from the projecting-recessing portion 46.

Figure 5:
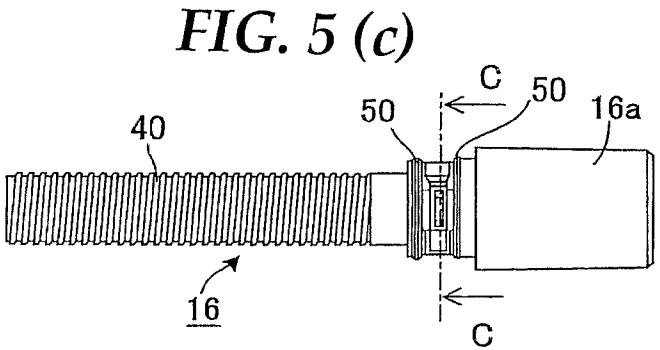
FIG. 5 is view for illustrating the rotating element of the liquid feeding container of FIG. 1, in which (*a*) is a longitudinal cross sectional view, (*b*) is a rear-side-hand perspective view, (*c*) is an external view seen from the side of a projection portion, (*d*) is a cross sectional view taken along the line C-C and (*e*) is an external view where the projection portion is positioned upward.
Figure 5:
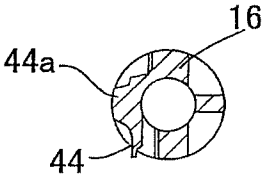
Figure 5:
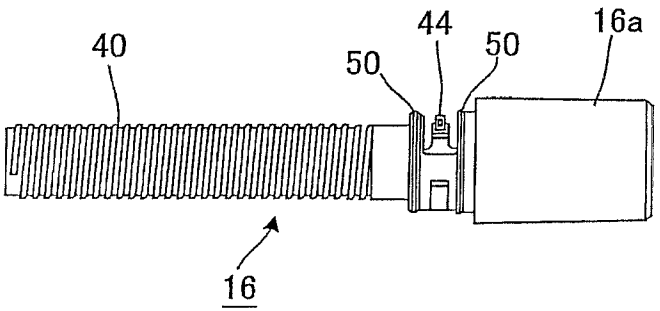
Figure 5:
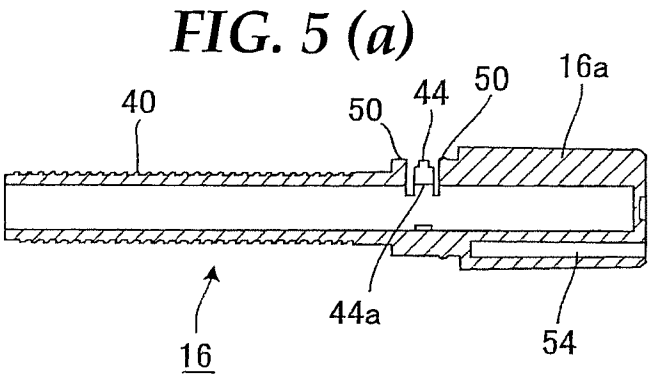
Figure 5:
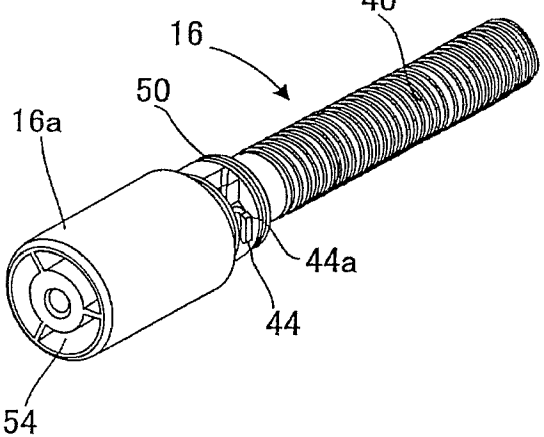

As shown in FIG. 5, the projection portion 44 is formed to be thin near a rocking fulcrum at the time of elastic deformation, and has an outer surface of a rocking arm portion 44*a* ahead from the fulcrum formed to be thick being projected outward from a wall surface of an outer peripheral wall portion of the above-described rotating element 16 adjacent to a periphery thereof.

Moreover, in an inner peripheral surface of the above-described barrel body 10 and a frontward outer peripheral surface of the operating portion 16*a* of the above-described rotating element 16, fitting portions 48 and 50 in which a plurality of recessing portions and cyclic projecting portions which regulate relative movement in mutual axial directions and enable relative rotation in rotational directions for the above-described rotating element 16 and the barrel body 10 are formed respectively at places opposing to each other (see FIG. 3 and FIG. 5). Specifically, as shown in FIG. 3, the fitting portions 48 and 48 in an inner periphery of the rear end portion of the barrel body 10 are formed as recess-shaped grooves on opposite sides of the above-described projecting-recessing portion 46. These fitting portions 48 and 48 and the projecting-recessing portion 46 are formed adjacent to an end surface of the rear end portion 10*b* of the barrel body 10 so that the above-described rotating element 16 is able to be mounted easily to improve assembly performance. In addition, as shown in FIG. 5, in the above-described rotating element 16, the fitting portions 50 and 50 which are formed to have an annular projecting configuration are formed on opposite sides of the formation place of the above-described projection portion 44, so that the projection portion 44 is hard to hit other members in mounting or the like, thus enabling to prevent occurrence of failure of the projection portion 44. Moreover, inner diameters of the fitting portions 48 and 48 of the barrel body 10 (approximate to outer diameters of the above-described fitting portions 50 and 50) are formed to be larger than outer diameters of the seal portion 18*a* and the cylindrical portion 18*b* of the above-described piston 18, and the seal portion 18*a*, even when passing in assembling, passes smoothly without interfering with the seal portion 18*a*, so that it is possible to secure sealing performance of the seal portion 18*a*.

Moreover, in the cylindrical portion 18*b* of the above-described piston 18, a rear-open slit 52 is formed to be cut along an axial direction and when the male thread portion 40 of the rotating element 16 is linked with the above-described cylindrical portion 18*b*, it is able to be mounted so that the cylindrical portion 18*b* opens from the slit 52 by elastic deformation without mating the male thread portion 40 to the female thread portion 38.

In addition, as shown in FIG. 5, the above-described rotating element 16 is formed into a hollow cylindrical shape over a front portion of the operating portion 16*a*, and the projection portion 44 is formed into a cantilevered shape in a wall portion of the above-described rotating element 16 in a hollow cylindrical shape and is formed to be thin near the rocking fulcrum at the time of elastic deformation and to have an outer surface of the rocking arm portion 44*a* formed being projected outward from the wall portion of the above-described rotating element 16 (in particular, see FIG. 5(*d*)). Note that, a resin such as polyethylene or polypropylene is able to be selected for the barrel cylinder 10, the piston 18 and the rotating element 16, but a resin such as ABS, PBT, polycarbonate or POM is preferably selected for the rotating element 16 in order to secure strength.

Description will be given for an operation of the liquid material feeding container according to an embodiment.

With the liquid material feeding container according to the embodiment, by relatively rotating the operating portion 16*a* of the rotating element 16 with the barrel body 10, the male thread portion 40 in the outer peripheral surface of the front portion of the rotating element 16 screw-feeds the female thread portion 38 in the inner periphery of the cylindrical portion 18*b* of the piston 18 to advance the piston 18 in the housing portion 12, thus making it possible to feed the content 14 to the frontward of the barrel body 10.

Accordingly, it is possible to configure the liquid material feeding container with a configuration having less parts of the barrel cylinder integral with the housing portion 12, the piston 18 integral with the cylindrical portion 18*b* in which the female thread is formed and the rotating element 16 in which the front portion in which the male thread is formed is integral with the operating portion 16*a*, and the cylindrical portion 18*b* is housed in the barrel body 10 and the male thread in the front portion of the rotating element 16 is mated with the female thread in the cylindrical portion 18*b* to carry out a feeding operation, thus making it possible to hold mating reliably with the barrel body 10 as a strength part.

Therefore, it is possible to provide the liquid material feeding container in which the number of parts is reduced while maintaining quality required for the rotational feeding container and assembly with a simple method is allowed so that the cost is reduced without changing impression of use compared to current products.

In addition, with the above-described liquid material feeding container, it is configured such that the projection portion 44 which is elastically urged outward in a radial direction is formed in the rotating element 16, the plurality of projecting-recessing portions 46 are formed in the inner peripheral portion of the barrel body 10, the above-described projection portion 44 is engaged with the above-described projecting-recessing portions 46 in a state where the male thread portion 40 of the above-described rotating element 16 is mated with the female thread in the cylindrical portion 18*b* of the piston 18, and the above-described projection portion 44 is engaged and disengaged with and from the projecting-recessing portions 46 when the rotating element 16 is caused to relatively rotate with the barrel body 10. With this configuration, in a state where the above-described projection portion 44 is engaged with the projecting-recessing portions 46, the above-described projection portion 44 is engaged and disengaged with and from the projecting-recessing portions 46 when the rotating element 16 is caused to relatively rotate with the barrel body 10, so that it is possible to rotate the above-described rotating element 16 with click feeling at the time of an operation, and a feed amount of liquid materials is easily grasped and to position and fix in a rotational direction of the rotating element 16 easily, thus the liquid materials are not fed unexpectedly.

Moreover, in the outer peripheral surface of the front portion of the above-described rotating element 16 and the inner peripheral surface of the above-described barrel body 10, fitting portions 48 and 50 which regulate relative movement in mutual axial directions and enable relative rotation in rotational directions for the above-described rotating element 16 and the barrel body 10 are formed respectively at places opposing to each other, so that it is possible to prevent the rotating element 16 from being fallen from the barrel body 10 reliably.

Moreover, in the cylindrical portion 18*b* of the above-described piston 18, the rear-open slit 52 is formed along the axial direction and when the male thread portion 40 of the rotating element 16 is linked with the cylindrical portion 18*b*, it is able to be mounted so that the cylindrical portion 18*b* opens from the slit 52 by elastic deformation without mating the male thread portion 40 to the female thread portion 38. With this configuration, when the rotating element 16 is linked with the cylindrical portion 18*b* of the piston 18, by thrusting the rotating element 16 into the cylindrical portion 18*b* without rotating the rotating element 16, it is possible to fit the male thread portion 40 into the female thread portion 38 and linking is enabled only by the thrusting operation without requiring the rotating operation, so that it becomes possible to carry out a linking step very easily and correctly.

In addition, the above-described rotating element 16 is formed into a hollow cylindrical shape over the front portion from the operating portion 16*a*. Since the operating portion 16*a* prevents sink mark and the like at the time of molding, the rotating element 16 is made hollow as shown in FIG. 5 and the operating portion 16*a* is also provided with a doubly hollow portion (dent) 54.

Moreover, the projection portion 44 is formed into a cantilevered shape in the wall portion of the above-described rotating element 16 in a cylindrical hollow shape, so that when the operating portion 16*a* is pinched with the fingers to carry out the rotating operation of the rotating element 16, the projection portion 44 is elastically deformed to fall toward the side of an inner diameter, and passes over the recessing portion of the projecting-recessing portion 46 to be fitted into the projecting portion, thus providing clicking feeling.

In addition, the projection portion 44 is formed to be thin near the rocking fulcrum at the time of elastic deformation, and has the outer surface of the rocking arm portion 44*a* ahead from the fulcrum to be thick being projected outward from the wall portion of the above-described rotating element 16, so that when the rotating element 16 is caused to rotate inversely, force to be pressed back when the projection portion 44 is engaged with the projecting-recessing portion 46 is caused, but the outer peripheral surface of the rocking arm portion 44*a* abuts against the inner peripheral surface of the projecting-recessing portion 46 to support the force to be pressed back, thus making it possible to prevent deformation of the rocking arm portion 44*a* and to prevent inverse rotation reliably.

EXPLANATIONS OF NUMERALS

10 barrel body
10*a* tip end portion
10*b* rear end portion
12 housing portion
14 content
16 rotating element
16*a* operating portion of rotating element
18 piston
18*a* seal portion of piston
18*b* cylindrical portion of piston
20 applying element
24 pipe joint
26 pipe
28 front barrel
30 seal ball
32 cap
32*a* inner cap
32*b* inner cap spring
34 agitation ball
36 projection in outer periphery of cylindrical portion
38 female thread portion
40 male thread portion
42 groove portion
44 projection portion of rotating element
44*a* rocking arm portion of projection portion
46 projecting-recessing portion in inner periphery of barrel body
48, 50 fitting portions of barrel body and rotating element
52 slit of cylindrical portion

What is claimed is:

1. A liquid material feeding container which houses liquid content in a housing portion provided in a barrel body, and causes an operating portion of a rotating element exposed from a rear end portion of the barrel body to relatively rotate with the barrel body so as to advance a piston in the housing portion and feed the content to the frontward of the barrel body, wherein the piston has a seal portion which slides in contact with an inner wall of the housing portion of the barrel body in a front portion thereof and is formed with a cylindrical portion having a female thread portion in an inner periphery thereof, a male thread portion which is mated with the female thread portion of the cylindrical portion is formed in an outer peripheral surface of a front portion extending frontward from the operating portion of the rotating element, wherein a projection portion which is elastically urged outward in a radial direction is formed, a plurality of projecting-recessing portions having rectangular shapes are formed in an inner peripheral portion of the barrel body, and in a state where the male thread portion of the rotating element is mated with the female thread portion in the cylindrical portion of the piston, the projection portion is engaged with the projecting-recessing portions, and when the rotating element is caused to relatively rotate with the barrel body, the projection portion is engaged and disengaged with and from the projecting-recessing portions, and when the rotating element is caused to inversely relatively rotate with the barrel body, the projection portion is pushed outwardly against the plurality of projecting-recessing portions to prevent further inverse rotation.

2. The liquid material feeding container according to claim 1, wherein fitting portions which regulate relative movement in mutual axial directions and enables relative rotation in rotational directions for the rotating element and the barrel body are formed respectively at places opposing to each other in the outer peripheral surface of the front portion of the rotating element and the inner peripheral surface of the barrel body.

3. The liquid material feeding container according to claim 2, wherein a rear-open slit is formed along an axial direction in the cylindrical portion of the piston, and when the male thread portion of the rotating element is linked with the cylindrical portion, it is able to be mounted so that the cylindrical portion opens from the slit by elastic deformation without mating the male thread portion to the female thread portion.

4. The liquid material feeding container according to claim 3, wherein the rotating element is formed into a hollow cylindrical shape over a front portion from the operating portion, and the projection portion is formed into a cantilevered shape in a wall portion of the rotating element in a hollow cylindrical shape and is formed to be thin near a rocking fulcrum at the time of elastic deformation and to have an outer surface of a rocking arm portion formed to be thick being projected outward from the wall portion of the rotating element.

5. The liquid material feeding container according to claim 2, wherein the rotating element is formed into a hollow cylindrical shape over a front portion from the operating portion, and the projection portion is formed into a cantilevered shape in a wall portion of the rotating element in a hollow cylindrical shape and is formed to be thin near a rocking fulcrum at the time of elastic deformation and to have an outer surface of a rocking arm portion formed to be thick being projected outward from the wall portion of the rotating element.

6. The liquid material feeding container according to claim 1, wherein a rear-open slit is formed along an axial direction in the cylindrical portion of the piston, and when the male thread portion of the rotating element is linked with the cylindrical portion, it is able to be mounted so that the cylindrical portion opens from the slit by elastic deformation without mating the male thread portion to the female thread portion.

7. The liquid material feeding container according to claim 6, wherein the rotating element is formed into a hollow cylindrical shape over a front portion from the operating portion, and the projection portion is formed into a cantilevered shape in a wall portion of the rotating element in a hollow cylindrical shape and is formed to be thin near a rocking fulcrum at the time of elastic deformation and to have an outer surface of a rocking arm portion formed to be thick being projected outward from the wall portion of the rotating element.

8. The liquid material feeding container according to claim 1, wherein the rotating element is formed into a hollow cylindrical shape over a front portion from the operating portion, and the projection portion is formed into a cantilevered shape in a wall portion of the rotating element in a hollow cylindrical shape and is formed to be thin near a rocking fulcrum at the time of elastic deformation and to have an outer surface of a rocking arm portion formed to be thick being projected outward from the wall portion of the rotating element.

* * * * *